United States Patent [19]

Stewart

[11] Patent Number: 4,990,009

[45] Date of Patent: Feb. 5, 1991

[54] COLOR CONVERTER FOR MONOCHROME DOT MATRIX PRINTERS

[76] Inventor: Jonn V. Stewart, 1308 Henry Balch Dr., Orlando, Fla. 32810

[21] Appl. No.: 373,689

[22] Filed: Jul. 3, 1989

Related U.S. Application Data

[63] Continuation-in-part of Ser. No. 201,923, Jun. 3, 1988, abandoned.

[51] Int. Cl.[5] ..... B41J 35/14

[52] U.S. Cl. ..... 400/216.3; 400/248

[58] Field of Search ..... 400/212, 213, 216, 216.1, 400/216.2, 216.3, 217, 217.1, 2294, 224.1, 224.2, 224, 247, 248

[56] References Cited

U.S. PATENT DOCUMENTS

| | | | |
|---|---|---|---|
| 4,280,767 | 7/1981 | Heath | 400/213 |
| 4,297,043 | 10/1981 | Dargatz | 400/248 |
| 4,728,207 | 3/1988 | Foster | 400/248 |

FOREIGN PATENT DOCUMENTS

| | | | |
|---|---|---|---|
| 98385 | 6/1982 | Japan | 400/216.1 |
| 131588 | 8/1982 | Japan | 400/224.1 |
| 55280 | 4/1983 | Japan | 400/217 |
| 158286 | 9/1983 | Japan | 400/217 |
| 172781 | 8/1986 | Japan | 400/248 |

*Primary Examiner*—David A. Wiecking

[57] ABSTRACT

A mechanism is disclosed for converting monochrome dot matrix printers to color printers by means of a ribbon shift mechanism on ribbon cartridges, the action of which is controlled by print head motion. The mechanism comprises a ribbon guide, which redirects the ribbon vertically across the print head. This guide is attached to the ribbon cartridge via a slide, which allows the ribbon to slide horizontally, across its width, effecting a shift relative to the head. Friction pads on the guide contact the print media, holding the guide still relative to the media until head motion exceeds the slide limit. Then the pads are moved to a new position on the media. The print head can thus move across the color bands of a multicolor ribbon, providing a color selection mechanism. A printer driver can control this to effect color printing.

Using this device, a monochrome dot matrix printer can be converted to color printing capability by simply replacing the ribbon cartridge and installing a supporting printer drive.

The invented device can also be used to spread strike wear over the width of the print ribbon, extending, and potentially doubling, ribbon life.

18 Claims, 5 Drawing Sheets

FIG 3
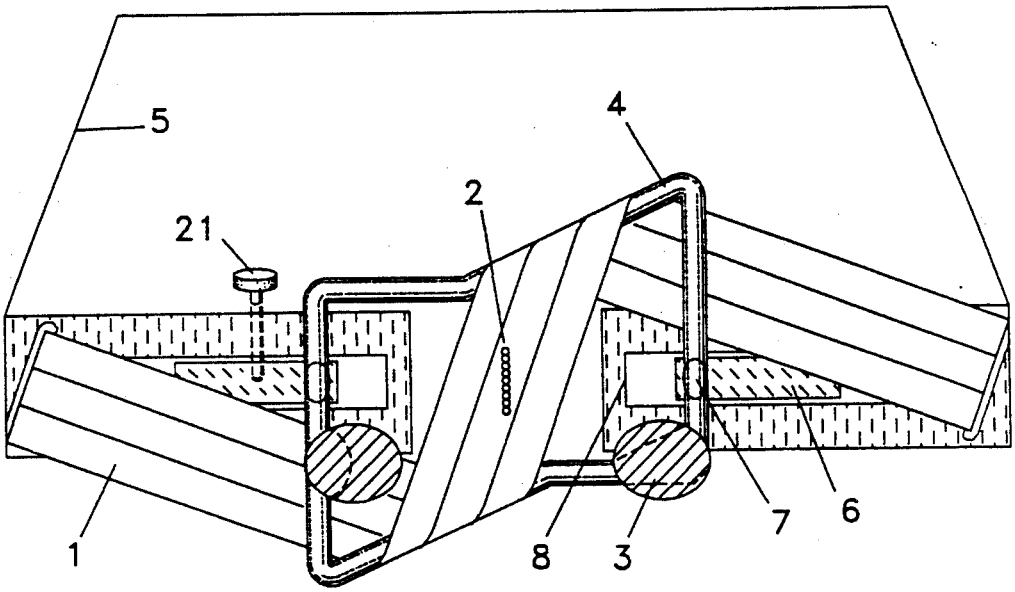
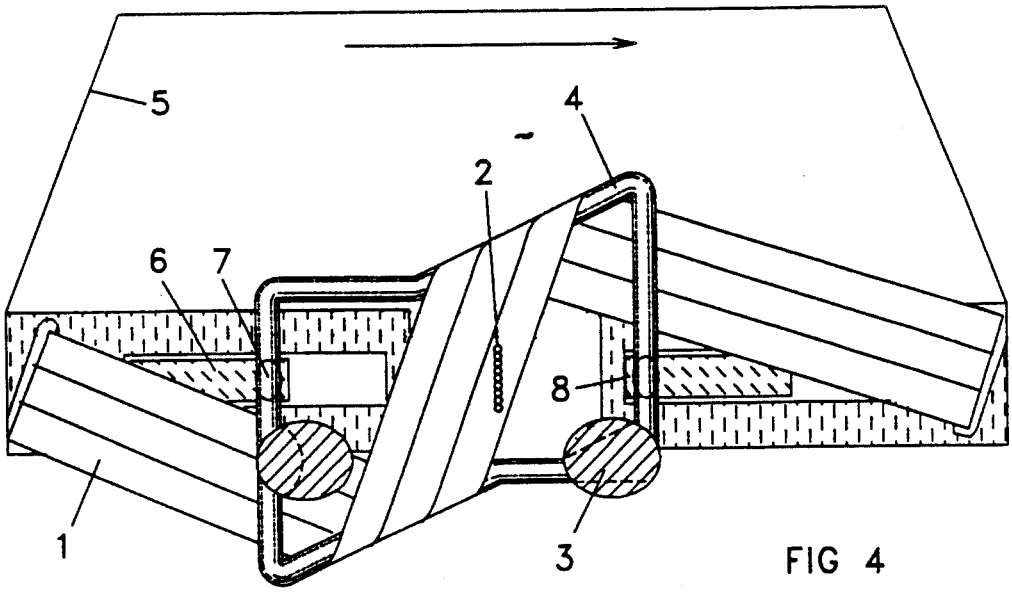
FIG 4

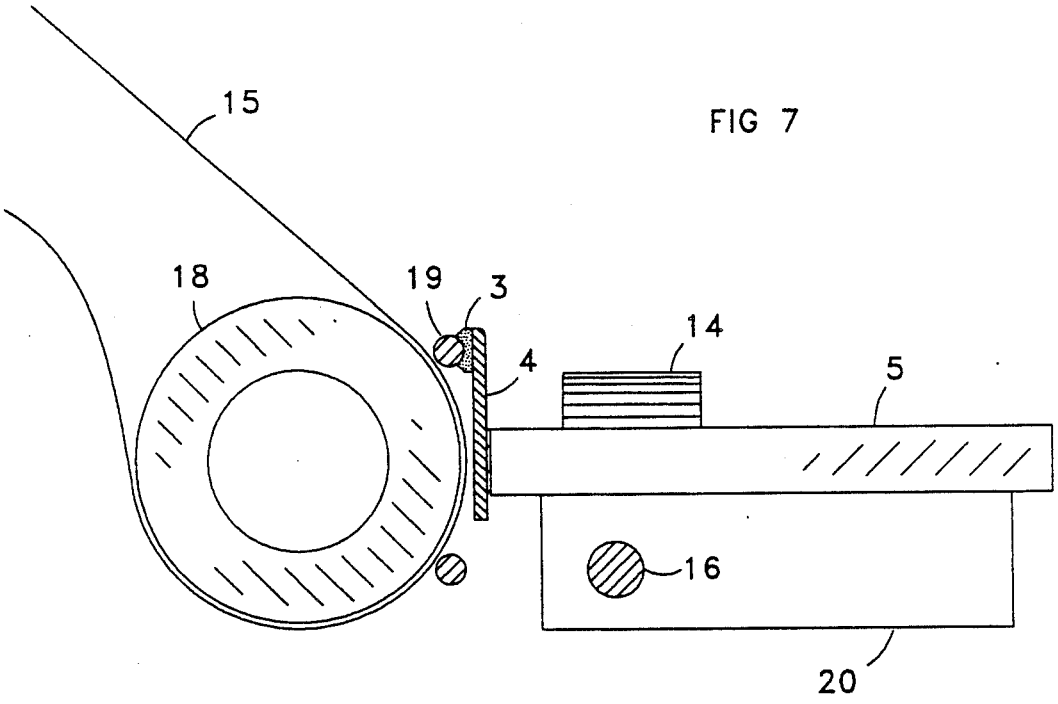
FIG 7
FIG 8
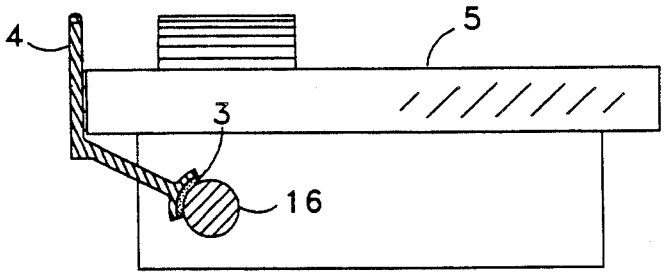

COLOR CONVERTER FOR MONOCHROME DOT MATRIX PRINTERS

This is a continuation-in-part of application Ser. No. 07/201,923, filed 6/03/88 now abandoned.

BACKGROUND

1. Field of the Invention

This invention relates to dot matrix printers.

2. Description of Prior Art

Dot matrix printers are versatile. They can produce text with selectable fonts and raster graphics. Some offer color printing via a multi-color ribbon which is mechanically shifted to hold a chosen color band before the print head. Since this shift mechanism adds considerable expense, many printers lack it, thus are only capable of monochrome printing.

Most owners of monochrome dot matrix printers Would be interested in a simple, inexpensive way of adding color printing capability to an existing printer.

OBJECTS AND ADVANTAGES

The object of this invention is to provide a simple, inexpensive color control mechanism for dot matrix printers, which can be easily installed by the owners of such printers.

Advantages include:

(1) Simplicity, as compared with the shift mechanism now used in color printers, and less expensive.
(2) Ease of installation as an upgrade.
(3) Expansion of the ribbon strike wear pattern to extend ribbon life, potentially approximately doubling the life of a monochrome ribbon.

DRAWING FIGURES

Figure 1:
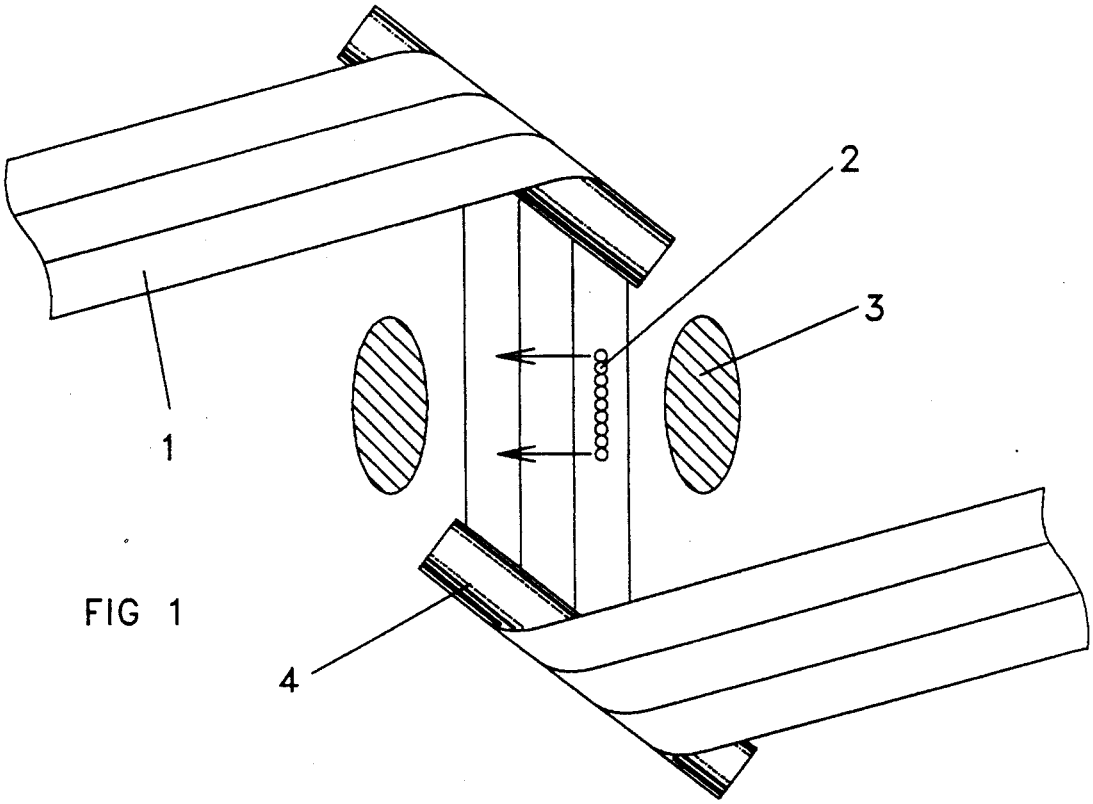

FIG. 1—A print ribbon, as viewed from the print head. The print media is behind the ribbon in this view.

Figure 2:
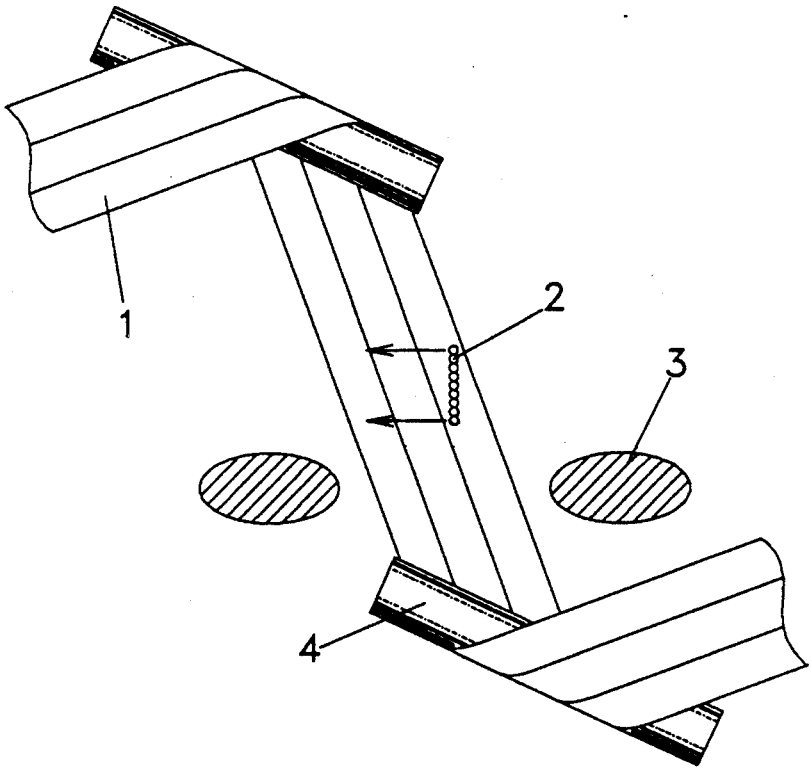

FIG. 2—Same view as FIG. 1 with two enhancements, as explained in the description.

FIG. 3—A ribbon cartridge with the invented mechanism.

FIG. 4—Same view as FIG. 3, with guide and ribbon shifted relative to the print head. Note the neW strike position of the pins 2. Cartridge motion is indicated by an arrow.

Figure 5:
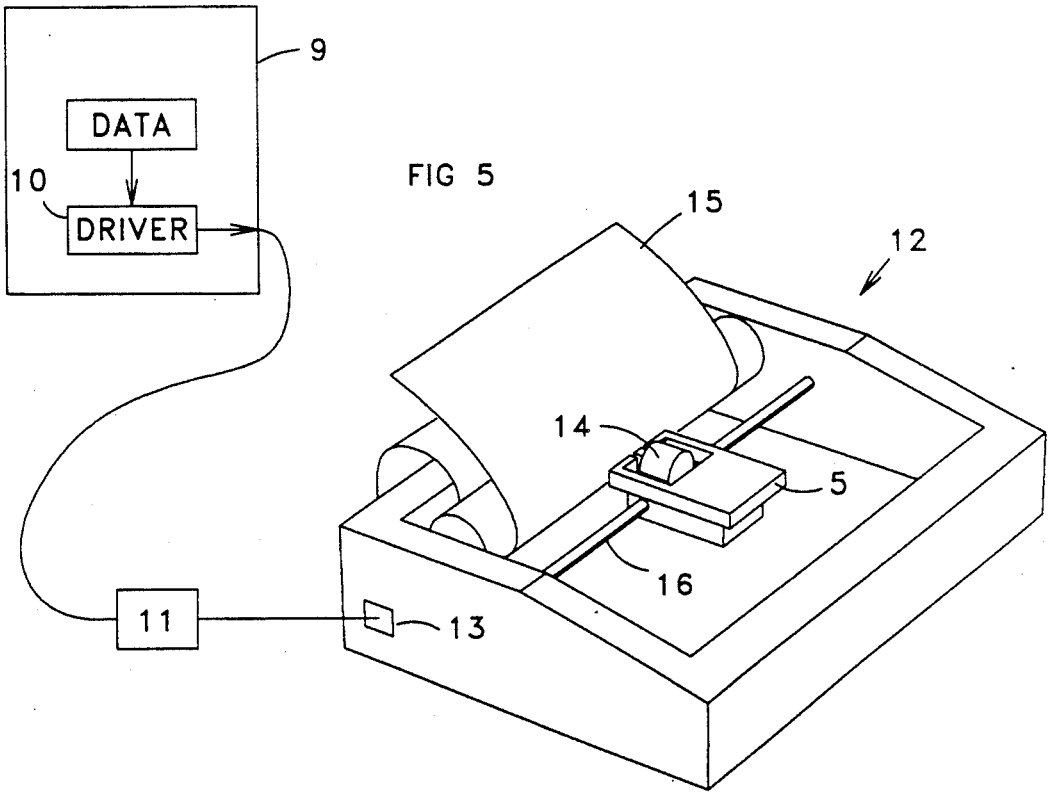

FIG. 5—Overview of the major printer components mentioned in the description and claims.

Figure 6:
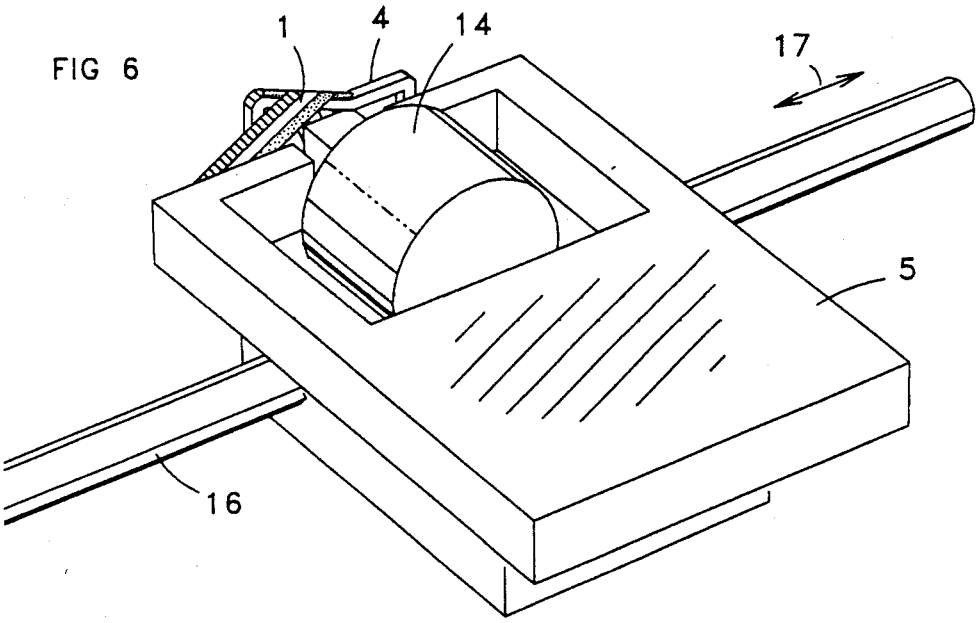

FIG. 6—Ribbon cartridge perspective rear view.

FIG. 7—Ribbon cartridge side view, friction pad against media guide.

FIG. 8—Ribbon cartridge side view, friction pad against track.

Figure 9:
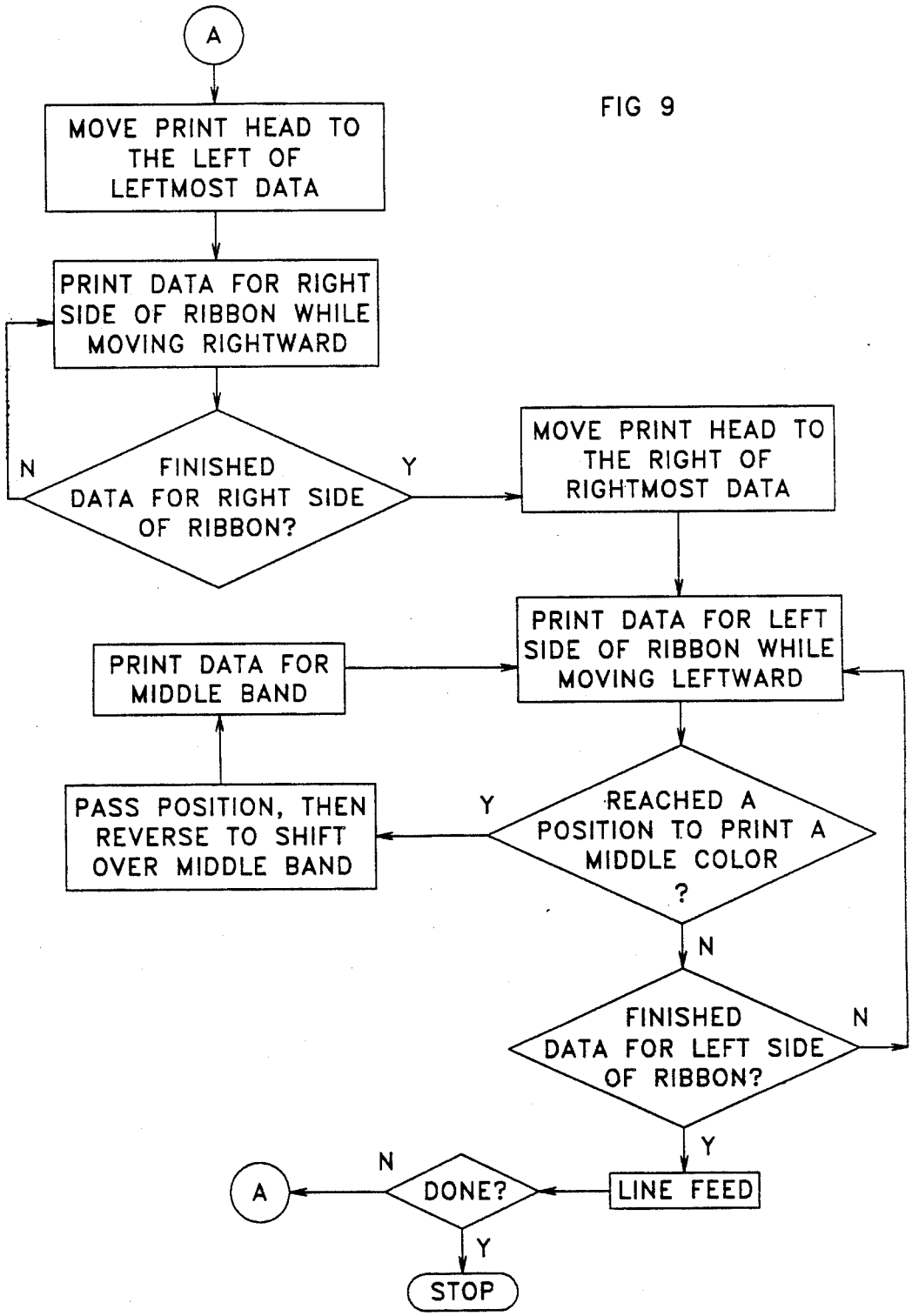

FIG. 9—Flow chart of control logic for use with multicolor ribbon.

DRAWING REFERENCE NUMERALS

1: Multicolor print ribbon
2: Strike position of print pins on the ribbon
3: Friction pads
4: Ribbon guide
5: Ribbon cartridge
6: Slide
7: Connection of guide to slide
8: Slide limit
9: Computer
10: Software controller
11: Hardware controller

12: Printer
13: Interface
14: Print head
15: Medium
16: Track or guide rail
17: Print head motion
18: Platen
19: Media guide or friction bar
20: Carriage
21: Slide lock.

DESCRIPTION

The invention comprises a guide which feeds a print ribbon vertically across a print head. This guide is connected to a ribbon cartridge or print head assembly via a slide, so that the ribbon can slide horizontally relative to the print head. This relative sliding motion is limited to the width of the ribbon, keeping the ribbon within striking range of the pins. The guide contacts the print media via friction pads, which hold the guide and ribbon stationary, relative to the media, until the slide limits are exceeded by motion of the head.

FIG. 1 shows a view of the active part of a multicolor ribbon 1 from the print head side. The current striking position of the print pins is shown by 2. Arrows show the range of motion of the print pins across the width of the ribbon. The contact area of the friction pads against the print media is shown as item 3. A guide bar or roller 4 is shown redirecting the ribbon from the usual horizontal orientation to a vertical orientation to cross the print head. Additional guide bars could be used to make the ribbon path stable and dependable.

FIG. 2 shows a variation of FIG 1 with two significant enhancements to the basic design. First, the ribbon 1 is guided at an oblique angle across the print head, thus spreading the pin strike zone over a width of ribbon, reducing ribbon wear. This oblique angle is an engineering variable which allows flexibility in finding a suitable placement for the guides, and in optimizing the ribbon width, feed rate, and strike wear pattern. Second, the contact area of the friction pads is below the level of the print matrix, to eliminate ink smearing. Friction could also be obtained against any part of the printer that is horizontally motionless relative to the print media, for example print media guides or the track upon which the print head assembly moves. Using pads against the print media is probably the simplest practical embodiment.

In some printers no horizontally motionless part may lend itself to optimal use with this invention. In this case, an existing part can be replaced with one designed to serve both the original and present purposes. For example, a paper guide with longitudinal obstructions, can be replaced with one without obstructions, or with a combined paper guide and friction bar.

On some printers it may be best to install a friction bar specifically for this device. Machine screws or bolts are sometimes conveniently and accessibly located near each end of the platen. In such cases, it is practical to install a friction bar spanning the platen, parallel to the printing direction, rather than rely on an existing part, Such a bar can be optimally positioned for this invention, since its position is not dictated by another use, such as paper guidance. Two opposed bars can be used to neutralize the net force on the ribbon guide perpendicular to the printing direction. For example, one bar above, and one below the guide can be used, or one bar in front of, and one behind, a vertical extension of the guide. Another option is to form the friction pad as a sleeve. This avoids net force on the ribbon guide perpendicular to the printing direction with a single friction bar. If a sleeve is used, a releasable coupling is needed to release the sleeve from the bar, and/or to release the sleeve from the ribbon guide. This allows the ribbon cartridge to be replaced without removing the friction bar.

The friction pad or pads can have a friction surface which is shaped to conform to the surface of the friction source. For instance, the pad can curve partly or completely around a friction bar. This increases friction by providing a larger contact area, and reduces pad wear by spreading pressure on the pad, making its friction more consistent over time.

FIG. 3 shows a ribbon cartridge VieWed from its active side, with ribbon guide 4 attached to the cartridge via horizontal slide 6. Friction pads 3 are attached to the guide. The cartridge case 5 is outlined for visual orientation. In this FIG., the ribbon guide is centered, so the print pins 2 are positioned over the central color band of the ribbon 1.

FIG. 4 shows the ribbon cartridge of FIG. 3 in motion, or having just moved, from left to right, thus the pins 2 are positioned over the rightmost color band of the ribbon 1.

OPERATION

When the print head moves, the ribbon guide remains motionless, allowing the head to move across the width of the ribbon until the slide limit is reached. Further motion past the limit of the slide moves the ribbon guide to a new position on the print media, against the light friction of the pads.

The horizontal motion of the print head relative to the vertically oriented ribbon is effectively a shift mechanism. The print pins strike a position on the width of the ribbon which is determined by the last direction of motion of the print head. Using a multicolor ribbon, this causes one color to be printed in one direction of head motion, a second color in the other direction, and additional colors by reversing direction for a short distance to the center of the ribbon. This can be controlled for color selection. A printer driver which emulates a color printer could therefore be designed and optimized for this mechanism.

Means to control the invented mechanism could be implemented in software and/or hardware. A hardware version could connect between the computer and the printer, converting signals destined for a color printer into appropriate control signals for a printer fitted with the invented mechanism. A software version could take the form of a printer driver, using the same execution parameters as a standard type of color printer driver, and producing output signals designed to control a printer fitted with the invented mechanism. It would be advantageous to provide an option to easily revert to monochrome print mode if desired.

A suggested control means is a preprocessor for existing printer drivers. The preprocessor emulates a color printer driver, and executes an existing printer driver as a subroutine. This allows existing printer drivers to remain unchanged, since the color emulation code is limited to the preprocessor. Reversion to monochrome mode is done either by switching to the original driver or by passing all execution calls directly to it. The preprocessor can be made generic, that is, one version of the preprocessor can control many different printers (within a given operating system). This is possible because the specialized code for each printer is in its driver, not in the preprocessor. This approach both simplifies the control means and reduces the number of different versions required to support different printers.

The following steps outline an example of the basic control sequence for this device. For this discussion, colors are numbered 1-N from the left to right on the vertical part of the ribbon. The viewpoint is facing the print media as though to read text as it is printed.

(1) Establish the print head position to the left, by the width of the ribbon, of the leftmost raster dots to be printed in color N on the current line.

(2) Move the head rightward, printing color N through to its rightmost occurrence on the line.

(3) Establish the print head position one ribbon width to the right of the rightmost raster dots to be printed in color 1 on the current line.

(4) Move the head leftward, printing color 1 through to its leftmost occurrence on the line.

(5) During steps 2 and/or 4, intermediate colors are printed by first moving the head past the column of raster dots to be printed, then reversing the head motion to position it over the desired intermediate color band on the ribbon. The distance to pass the raster column is the distance of the intermediate band from the side of the ribbon which is in the direction of head motion.

(6) Line feed and repeat from step 1.

This control sequence should be optimized to eliminate unnecessary motion.

RIBBON SAVER EMBODIMENT

The invented mechanism could be used to spread strike wear over the width of a ribbon, whether color or monochrome, prolonging ribbon life. Enhancing this usage would be an oblique angle of ribbon direction as it crosses the print head. Also the ribbon slide limit could be made variable so strike wear could be moved from the edges to the central part of the ribbon. A simple embodiment of the invention would optimize the angle of the ribbon and the slide range to produce a strike wear pattern of two bands, almost meeting at the center of the ribbon, and extending almost to the ribbon's edges. This would double the life of the ribbon. For this embodiment, no special driver or control means would be needed, since the wear pattern Would be automatically spread during normal bidirectional printing.

PREFERRED EMBODIMENT

A simple ribbon saver embodiment should be available. No control means is needed, and friction means can be the simplest practical for a given printer. The preferred color embodiment is as in FiG. 3, but uses a bar and detachable sleeve as friction means, with control means implemented as a printer driver preprocessor.

PRACTICAL CONSIDERATIONS

Friction pads which contact the print media can do so below the ribbon to avoid smearing the ink.

The engineering involved in guiding the ribbon from a horizontal to vertical orientation will vary, depending on each variety of printer and ribbon cartridge. It can be done with guide bars or rollers with essentially cylindrical or conic shapes, modified for stabilization of the ribbon path. An example of such a guide bar or roller is shown as item 4 in the drawings.

Control means should optimize the head motion for the best printing speed in color mode. Color ribbons should have the two most frequently used colors on the outside color bands, since these bands are accessed most efficiently.

A monochrome option should be available, via the following means:

(1) replace the ribbon cartridge with a monochrome ribbon cartridge (this option will always be available), (2) provide a manually activated lock on the slide of the ribbon guide, Which limits ribbon shift to the range of one color band (a convenient option for temporary monochrome printing, but not essential), (3) Provide an easily switchable printer driver option for bidirectional monochrome mode, in addition to the color mode (this would be used in conjunction with 1 or 2, above).

CLAIM TERMINOLOGY

The term "widthwise portions" means conceptual widthwise divisions of the ribbon into longitudinal bands. These portions may be physically different, as in the case of a multicolor ribbon, or physically the same, as with a monochrome ribbon.

I claim:

1. In a printer of the type having a ribbon, a printhead, and a medium on which information can be printed, said printhead being movable back and forth in a printing direction across said medium, said ribbon having a plurality of widthwise portions and including an active section disposed in operative engagement between said print head and said medium, and improvement for providing ribbon-shifting capability, wherein the improvement comprises:

ribbon guide means for directing the active section of said ribbon at an angle nonparallel to the printing direction;

slide means for low-friction shifting of said ribbon guide means, relative to said print head in a direction generally parallel to the printing direction;

means for limiting the distance said slide means can shift in the printing direction relative to said print head; and friction means on said ribbon guide means responsive to movement of said print head in the printing direction, for changing which one of said portions of the ribbon is in operative engagement with the printhead by transmitting a frictional engagement from said medium to said ribbon guide means as said print head moves in the printing direction.

2. The improvement of claim 1 wherein some of said portions differ in color.

3. The improvement of claim 1 wherein said portions are all of the same color.

4. The improvement of claim 1 wherein said friction means comprises a pad connected to said ribbon guide means and touching said medium.

5. The improvement of claim 4 wherein said pad contacts said medium below the level of said print head.

6. The improvement of claim 1, further including lock means for locking said slide means.

7. The improvement of claim 1, further including control means for sending electronic signals to said printer to print data for the rightmost portion of the active section of said ribbon while moving the print head rightward, to print data for the leftmost portion of the active section of said ribbon while moving the print head leftward, and to print data for the middle portion of said ribbon after reversing the head movement by approximately the distance from the side of said ribbon to the middle of said ribbon.

8. The improvement of claim 1, further including an elongated friction bar, installed parallel to said printing direction, wherein said friction means comprises a pad connected to said ribbon guide means and touching said friction bar.

9. The improvement of claim 8 wherein said pad is curved to fit the surface of said friction bar.

10. In a printer of the type having a ribbon, a printhead, and a medium on which information can be printed, said printhead being movable back and forth in a printing direction across said medium, said ribbon having a plurality of widthwise portions and including an active section disposed in operative engagement between said print head and said medium, said printer also including a fixed part which is horizontally motionless relative to said medium, an improvement for providing ribbon-shifting capability, wherein the improvement comprises:

ribbon guide means for directing the active section of said ribbon at an angle nonparallel to the printing direction;

slide means for low-friction shifting of said ribbon guide means, relative to said print head in a direction generally parallel to the printing direction;

means for limiting the distance said slide means can shift in the printing direction relative to said print head; and friction means on said ribbon guide means, responsive to movement of said print head in the printing direction, for changing which one of said portions of the ribbon is in operative engagement with the printhead by transmitting a frictional engagement from said horizontally motionless part to said ribbon guide means as said print head moves in the printing direction.

11. The improvement of claim 10 wherein some of said portions differ in color.

12. The improvement of claim 10 wherein said portions are all of the same color.

13. The improvement of claim 10 wherein said friction means comprises a pad connected to said ribbon guide means and touching said horizontally motionless part.

14. The improvement of claim 13 wherein said pad has a surface conforming to the surface of said horizontally motionless part.

15. The improvement of claim 10 wherein horizontally motionless part comprises a track on which said print head is guided.

16. The improvement of claim 10 wherein said horizontally motionless part comprises a print media guide.

17. The improvement of claim 10, further including lock means for locking said slide means.

18. The improvement of claim 10, further including control means for sending electronic signals to said printer to print data for the rightmost portion of the active section of said ribbon while moving the print head rightward, to print data for the leftmost portion of the active section of said ribbon while moving the print head leftward, and to print data for the middle portion of said ribbon after reversing the head movement by approximately the distance from the side of said ribbon to the middle of said ribbon.

* * * * *